United States Patent [19]

Bumann

[11] 3,974,920

[45] Aug. 17, 1976

[54] MACHINE LOADER AND UNLOADER

[75] Inventor: Richard Leigh Bumann, Olivenhain, Calif.

[73] Assignee: Burroughs Corporation, Detroit, Mich.

[22] Filed: Nov. 18, 1974

[21] Appl. No.: 524,752

[52] U.S. Cl. ..... 214/1 F; 214/1 BB; 271/232

[51] Int. Cl.[2] ..... B65G 35/00

[58] Field of Search ..... 214/1 F, 1.1–1.7, 214/1 BB, 1 BT, 1 R, 16.6; 198/179, 180; 100/215; 271/232

[56] References Cited

UNITED STATES PATENTS

| | | | |
|---|---|---|---|
| 2,959,412 | 11/1960 | Sjostrom | 214/1 F X |
| 3,029,957 | 4/1962 | Freeman et al. | 214/1 BB |
| 3,113,767 | 12/1963 | Halberstadt | 214/1 BB X |
| 3,116,658 | 1/1964 | Baker | 271/232 X |
| 3,233,751 | 2/1966 | Bannon | 214/1 BB |

*Primary Examiner*—Frank E. Werner
*Attorney, Agent, or Firm*—G. Gregory Schivley; Kevin R. Peterson; Mervyn L. Young

[57] ABSTRACT

A loader-unloader is disclosed which can controllably move a workpiece into and out of a workstation in a machine without danger to the machine operator. The loader-unloader has a table which supports the workpiece and aligns it with the workstation. A plurality of clamps are used to grip the workpiece. One clamp is provided for each part of the workpiece exiting the machine. The working faces of the clamps make point or line contact with the workpiece so that it can be moved slightly in the clamps under the influence of aligning means on the table and in the machine. The clamps lift the lower portion of the workpiece as it is moved toward the workstation to reduce frictional resistance and to prevent the lower portion of the workpiece from being scratched. In operation, the machine operator places the workpiece on the table and initiates the loader-unloader cycle. The workpiece is clamped and aligned and then moved forward into the workstation. The machine operates on the workpiece which is then withdrawn from the machine. The entire loader-unloader and machine cycles can be combined for automatic operation or can be individually controlled manually.

3 Claims, 3 Drawing Figures

MACHINE LOADER AND UNLOADER

BACKGROUND OF THE INVENTION

The present invention relates to a machine for loading and unloading the workstation of a machine to protect the machine operator from serious injury in the event the machine malfunctions. It is common practice for machine operators, particularly die and punch press operators, to place their hands and portions of their arms between the working faces of the machine while placing workpieces into and while removing the finished workpiece from the machine. The motor and flywheel of the machine run continuously with the operator controlling the clutch which actuates the working faces with a pair of palm switches. If the machine accidentally operated while the operator was manipulating the workpiece, serious injury would result with the operator losing both hands and forearms.

In order to provide some measure of protection from the aforementioned type of injury, presses have been designed with a movable lower working face which is pushed down and out of the machine to receive the workpiece. The operator places the workpiece on the lower face and actuates the machine. The workpiece and lower face are drawn back into the machine. The machine operates and again pushes out the lower working face and finished workpiece.

While the above described type of machine does tend to protect the operator, another serious problem is caused by the movement of the working face. That is, the registration of the workpiece with the upper working face of the machine. The workpiece must remain properly aligned on the lower working face and the lower working face must be aligned precisely with the upper working face. These two registration problems seriously affect the speed of operation of the machine and the accuracy of the work which is produced.

The loader-unloader of the present invention overcomes each of the aforementioned problems and allows both the operator and the machine to operate quickly, accurately, and, above all, safely.

SUMMARY OF THE INVENTION

The loader-unloader of the present invention has a table for supporting a workpiece in alignment with the workstation in a machine such as a punch or die press. A longitudinally movable carriage is supported on and guided by the table. A plurality of clamps are provided on the carriage for gripping each piece of the finished workpiece. The working faces of the clamps are shaped to provide point or line contact with the workpiece so that the workpiece can be moved slightly in the clamps under the influence of aligning means on the table and in the machine.

In operation, the machine operator places a workpiece, for example, a sheet of copper laminated plastic containing several printed circuit patterns, onto the table. The table has initial workpiece aligning means which the operator uses to properly register the workpiece with the clamps on the loader-unloader and with the workstation in the machine. After the workpiece is in position on the table, the operator presses the start switch which causes the clamps to grip the workpiece. The aligning pins on the table are retracted and the carriage and clamps begin to move toward the workstation in the machine. Cam and followers for each clamp cause the clamps to lift the edge of the workpiece off of the table thereby protecting the workpiece from being scratched. This is particularly important if the workpiece is a double sided printed circuit board which would have one or more circuit patterns in contact with the surface of the table.

The workpiece is then moved longitudinally along the table and into the workstation of the machine where it again comes in contact with aligning means. If the workpiece becomes misaligned while moving along the table, the aligning pins in the machine can correct the error while the workpiece is clamped tightly. The limited contact of the working faces of the clamps reduces the resistance to lateral sliding while still maintaining adequate gripping force on the workpiece.

As the carriage approaches the end of its path of travel toward the machine, it comes into contact with a shock absorber which slows the carriage and eventually brings it to a stop. The carriage is gradually slowed before stopping to ensure proper position of and control of the workpiece.

Once the workpiece is in the workstation of the machine, the machine can operate. The operation of the machine can be controlled manually or a sensor can trigger the machine after the workpiece is in position. It is apparent that whichever mode of operation is selected, there is no reason for the operator to ever be exposed to injury.

During the operation of the machine, the clamps continue to hold the workpiece. When the machine is finished, the clamps withdraw the workpiece or possibly pieces from the machine. An individually controllable clamp is provided for each piece of the finished workpiece. Since the clamps are controlled separately, they can be caused to release the parts of the workpiece at different times and at different locations along the path of travel of the carriage. As the carriage and associated clamps approach the end of the table, they are again controllably decelerated and stopped. The workpiece locator pins are reset and the clamps open. Following removal of any remaining portion of the workpiece, the loader-unloader is ready to begin the cycle again.

The machine operator can be stationed at the loading and unloading position completely clear of the working faces of the machine. The workpiece is controlled continually by the loader-unloader to limit any problem due to improper registration of the workpiece. Also, the working faces of the machine can be locked in registration since there is no need for the lower working face to move in order to receive a new workpiece. The loader-unloader can also operate at high speed since the workpiece is constantly clamped in place. Also, the controlled deceleration of the carriage limits the inertia affect on the workpiece maintaining it in registration and thereby allowing the machine to operate rapidly.

DETAILED DESCRIPTION

Figure 1:
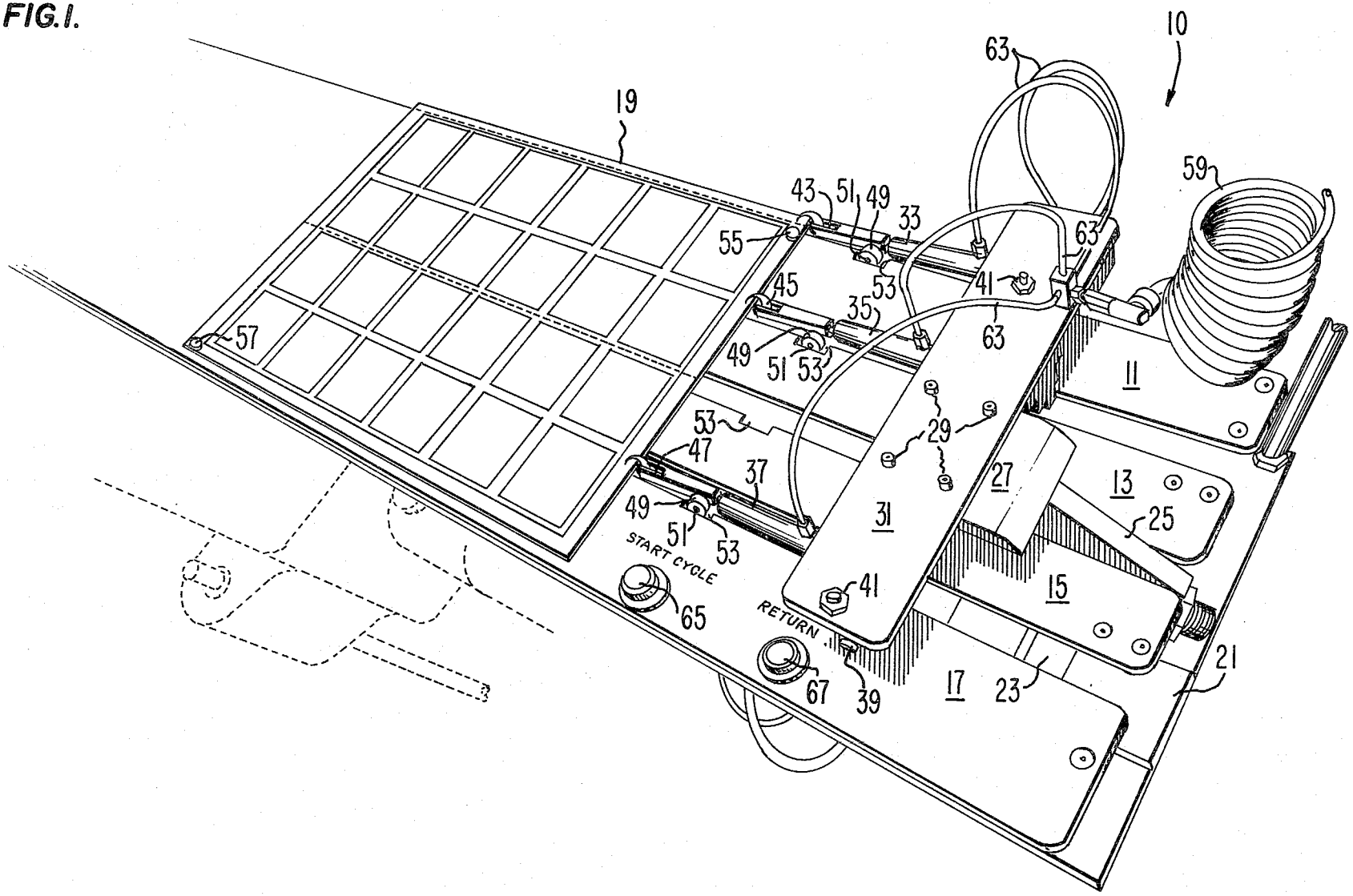
FIG. 1 is a partial perspective view of the loader-unloader showing a workpiece in position on the table.

Referring to FIG. 1, the loader-unloader 10 has a workpiece supporting table, the upper surface of which is formed from rectangular guide pieces 11, 13, 15, and 17. The table should be long enough, wide enough, and strong enough to support the workpiece 19. As shown in FIG. 1, the workpiece 19 is a copper plastic laminate containing several repeated electrical circuit patterns. The upper surface of the table is separated from the lower surface 21 by spacers 23, only one of which is shown.

A longitudinally movable carriage 25 is supported on and guided by the table. The carriage has a flat top portion 27 to which is attached, by means of bolts and nuts 29, the clamp cylinder pivot support 31. One end of each of the clamp control cylinders 33, 35, and 37 is supported by a pivot shaft 39 which is attached to the support 31 by means of the bolts and nuts shown at 41.

The control cylinders 33, 35, and 37 have associated clamps 43, 45, and 47 for controlling the workpiece 19 as it is moved into the machine and for removing the severed portion of the workpiece from the machine after the work cycle is completed. As shown in FIG. 1, three clamps are provided since the workpiece 19 is to be cut into three portions as shown by the dotted lines.

The control cylinder and clamps are supported on the table by means of wheels 49 on axles 51. Referring to FIG. 1, each of the wheels 49 is shown at rest in a recess 53 in the surface of the associated table guide piece. A ramp surface is provided in each of the recesses to cam the associated wheel out of the recess and up onto the surface of the table. When the wheel rises to the table surface, the clamp and the rear end of the workpiece are lifted, separating the lower face of the workpiece from contact with the surface of the table. The table piece 15 also has a recess 53 in the event the workpiece is to be cut into one more portion. If so, an additional control cylinder and clamp can be attached to the carriage to control the additional piece.

Locating pins 55 and 57 are shown at diagonal corners of the workpiece 19. The locating pins hold the workpiece in proper alignment on the loader-unloader. The clamps 43, 45, and 47 are shaped to provide limited contact, for example, point or line contact with opposed surfaces of the workpiece. By limiting the contact area of the clamp face, the workpiece can be moved slightly under the influence of the locator pins while the clamp grips the workpiece.

The loader-unloader of the present invention can be implemented in pneumatic, hydraulic or electronic form. The preferred and simplest is the pneumatic form and that is the configuration illustrated in each of the figures.

A coil hose 59 supplies air to each of the clamp control cylinders through a hose fitting 61 and hoses 63. Additional hoses 63 can be added to fitting 61 for the operation of additional control cylinders. A start button 65 and a return button 67 are shown in FIG. 1. The operation of these buttons will be fully described in relation to FIG. 3.

Figure 2:
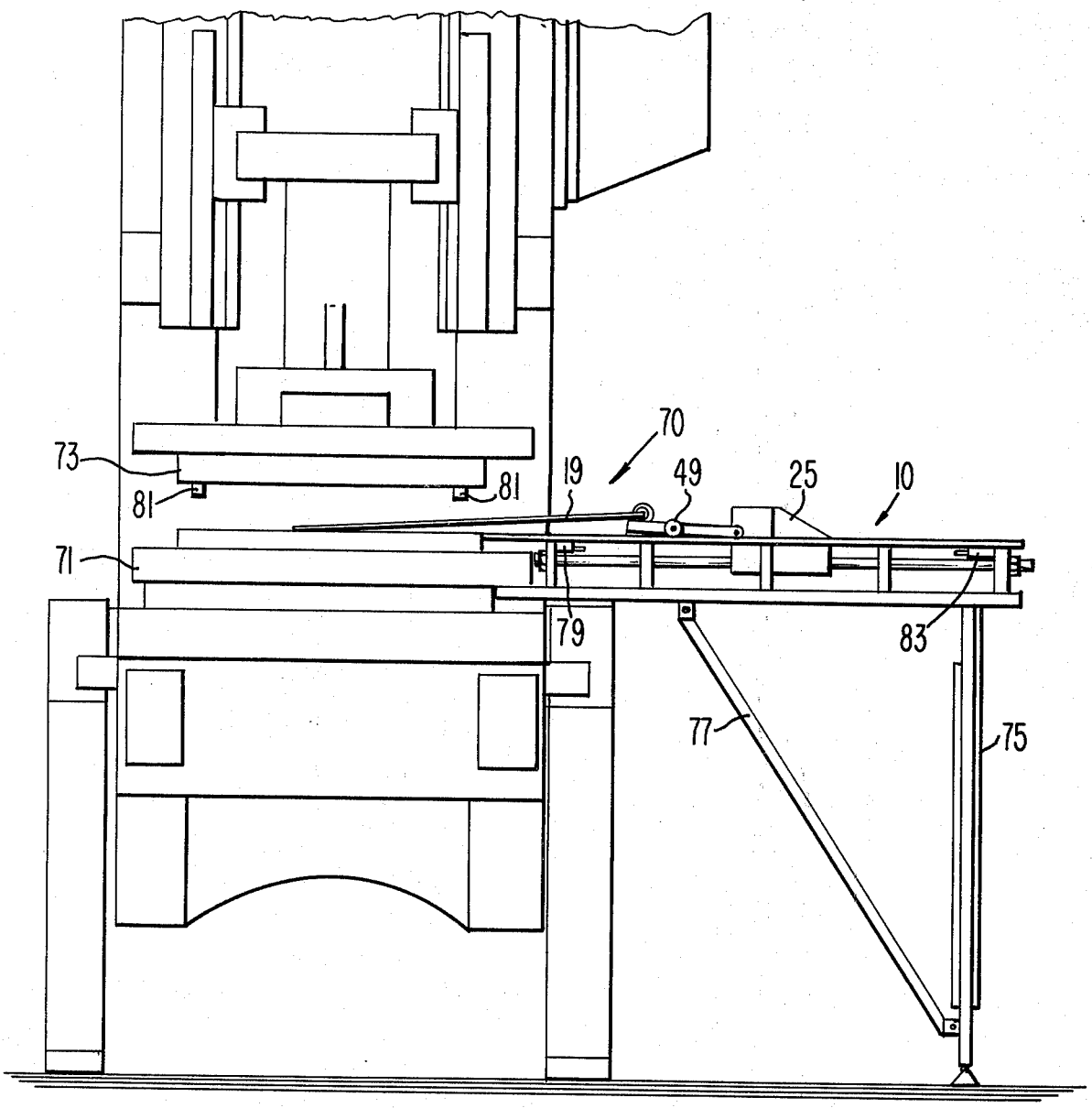
FIG. 2 shows the loader-unloader moving a workpiece into the workstation of a die press.

Referring to FIG. 2, the loader-unloader 10 is shown as it would be used with a die press 70. The die press 70 has a fixed lower working face 71 and a reciprocating upper working face 73. The pair of working faces coast on the workpiece 19. As previously described, the die press 70 is to cut the workpiece 19 into three portions.

The loader-unloader is positioned next to the die press 70 with the workpiece supporting table even with the lower working face 71. A set of adjustable legs 75 support the loader-unloader. A diagonal brace 77 is provided to strengthen the table and to reduce the vibration caused by the movement of the carriage 25.

As the carriage 25 advances the workpiece 19 into the workstation of the die press 70, the lower portion of the carriage comes into contact with a ram 79 which controllably decelerates and then stops the movement of the carriage. As the carriage reaches the end of its forward path of travel, the wheels 49 which support the clamps move down into a recess, not shown, to bring the workpiece 19 into full contact with the lower die press working face 71.

The operation of the die press can then be initiated manually or automatically by sensing the presence of the workpiece. As the upper working face 73 descends, locating pins 81 first enter locating holes in the workpiece to properly position the workpiece relative to the working faces. Since the clamps are configured to have limited contact with the workpiece, it is free to move in the clamps under the influence of the locating pins 81 to assure proper registration.

After the workpiece has been operated on, the upper working face 73 returns to its rest position. The carriage 25 then begins to withdraw the severed portions of the workpiece from the die press. The clamps 43, 45, and 47 can be controlled separately to drop portions of the workpiece at separate locations along the path of travel. For example, the thin portion of the workpiece held by clamp 43 could be released into a scrap bin while the two portions held by clamps 45 and 47 are returned to the machine operator for removal and stacking. A ram 83 controllably decelerates and stops the carriage 25 when it reaches the operator.

Figure 3:
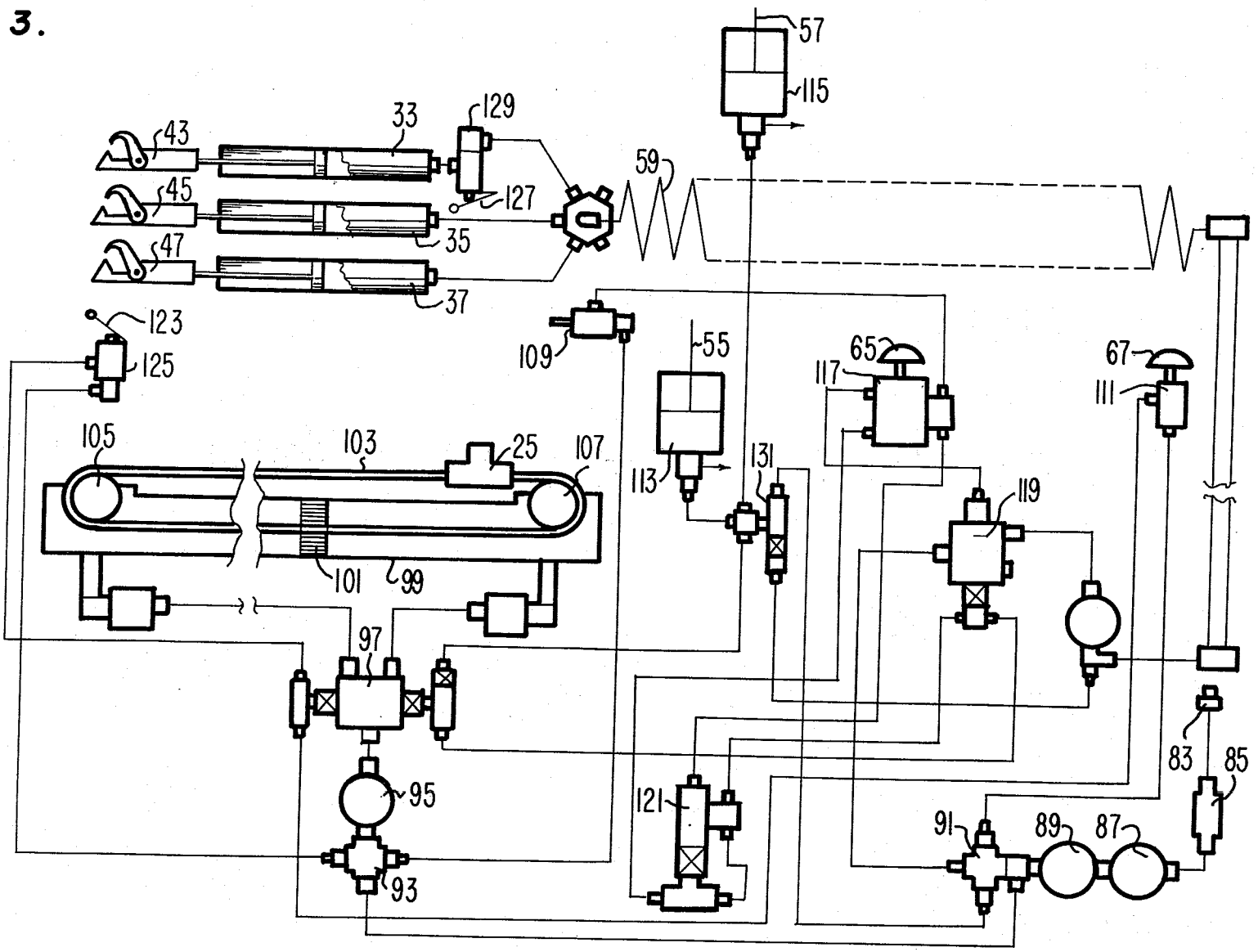
FIG. 3 is a schematic view of the pneumatic control system of the loader-unloader.

The pneumatic control system for the loader-unloader will now be described in relation to the schematic shown in FIG. 3. A source of high pressure air is applied to the system through connector 83 and coupling 85. Pressure valves 87 and 89 are used to adjust the pressure of the air used in the system so that it is high enough to properly operate the system while still being low enough to be manually overcome by the operator in case of difficulty or an emergency. The preferred air pressure is 40 pounds per square inch.

When the loader-unloader is ready for operation, air pressure is applied through the cross fitting 91, cross fitting 93, pressure regulator 95 and four-way valve 97 to the right portion of the double acting cable cylinder 99. The piston 101 moves to the left drawing the carriage 25 to the right by means of cable 103 which is coupled to either side of the piston 101 and passes around pulleys 105 and 107. The carriage 25 is held against normally closed three-way ram 109.

Air pressure is also applied to the normally closed three-way return valve 111 which is operated by button 67 as shown in FIG. 1. When the button 67 is depressed, air pressure operating through the valve 111 causes the cable cylinder 99 to reverse its direction of travel and to return the carriage 25 to its rest position in contact with the ram 109.

The air pressure which is applied to the cable cylinder 99 to retain it in its rest position is also applied to the cylinders 113 and 115 to raise the locating pins 55 and 57 for the initial alignment of a workpiece. The start button 65 controls the operation of four-way valve 117 which has air pressure applied to it through the ram 109 and through the cross coupling 91. Valve 117 controls the operation of four-way valve 119 and normally closed three-way valve 121.

When the start button 65 is depressed, the following changes take place in the system:

1. Air pressure is applied through the hose 59 to each of the clamp control cylinders 33, 35, and 37 causing the clamps to grip the workpiece.
2. Pressure is vented from cylinders 113 and 115 allowing locating pins 55 and 57 to recede below the working surface of the table.
3. The flow of air is diverted from the right side of the cable cylinder 99 to the left side causing the piston 101 to move drawing the cable 103 and the carriage 25 to the left.

The carriage 25 will continue to move to the left until it is stopped by ram 79. As mentioned previously, the movement of the carriage 25 can be reversed by depressing return button 67.

When the workpiece 19 is in position on the lower working face 71, the die press 70 can be operated either manually or automatically. In operating, the upper working face 73 descends to act on the workpiece. As the upper working face rises to its initial or rest position the one-way operating follower 123 actuates the three-way valve 125 which causes the flow of air through four-way valve 97 to be reversed. The air now enters the right end of the double acting cable cylinder 99 causing the piston 101 to move to the left thereby drawing carriage 25 to the right.

The clamp control cylinders 33, 35, and 37 can be actuated to release the workpiece at different locations along the path of travel of the carriage. In FIG. 3, the clamp control cylinder 33 is controlled by follower 127 which actuates three-way valve 129 to release the air pressure opening clamp 43 and releasing the workpiece. Each of the other clamp control cylinders can be similarly operated to control the gripping action of the clamps.

As the carriage 25 moves to the right, it comes into contact with ram 109. Further motion of the carriage causes the ram to operate restoring the initial air pressure condition to valves 117, 119, and 121. The air pressure is released from each of the clamp control cylinders and the cylinders 113 and 115 are pressurized through three-way valve 131 which causes locating pins 55 and 57 to project upwardly. The loader-unloader is now ready to begin another cycle of operation.

It will be apparent that many changes and modifications of the several features described herein may be made without departing from the spirit and scope of the invention. It is therefore apparent that the foregoing description is by way of illustration of the invention rather than limitation of the invention.

While a particular embodiment of the invention has been shown, it will be understood, of course, that it is not desired that the invention be limited thereto since modifications may be made, and it is, therefore, contemplated by the appended claims to cover any such modifications as fall within the true spirit and scope of the invention.

What is claimed is:

1. A workpiece loader-unloader for a machine comprising:

a table with a major surface for supporting a workpiece in alignment with a work station in the machine;

a carriage supported by said table and longitudinally movable thereon;

retractable posts projecting from said table surface for aligning said workpiece;

gripping means disposed on said carriage for gripping the workpiece, said gripping means being mounted on wheels disposed in a recess in the table surface during initial contact of the workpiece by the gripping means;

means for retracting said posts from said table surface;

driving means for moving said carriage along the table surface toward and away from the work station, said wheels of said gripping means riding on the table surface during movement toward the work station to thereby raise the workpiece from the table surface; and control means for said driving means and said gripping means to control the motion of said driving means and the gripping action of said gripping means.

2. The workpiece loader-unloader of claim 1 wherein said gripping means comprises a plurality of separately controllable pairs of gripping faces.

3. The workpiece loader-unloader of claim 2 wherein said gripping means comprises at least one pair of gripping faces for each piece of the workpiece exiting the work station whereby each workpiece can be released from its respective pair of gripping faces at different locations during withdrawal from the work station.

* * * * *